US008910932B2

(12) United States Patent
Rasmussen et al.

(10) Patent No.: US 8,910,932 B2
(45) Date of Patent: Dec. 16, 2014

(54) SEPARATOR ASSEMBLY FOR USE WITH PRINTERS

(75) Inventors: Steve O. Rasmussen, Vancouver, WA (US); Allan G. Olson, Bremerton, WA (US); Michael L. Gustafson, Escondido, CA (US); Abdolreza Movaghar, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 13/174,163

(22) Filed: Jun. 30, 2011

(65) Prior Publication Data

US 2013/0001863 A1 Jan. 3, 2013

(51) Int. Cl.

| | |
|---|---|
| ***B65H 3/52*** | (2006.01) |
| ***B65H 3/56*** | (2006.01) |
| ***B65H 3/06*** | (2006.01) |

(52) U.S. Cl.

CPC ..... *B65H 3/565* (2013.01); *B65H 3/0684* (2013.01); *B65H 3/5215* (2013.01); *B65H 2403/512* (2013.01); *B65H 2405/1136* (2013.01)

USPC ..... 271/121

(58) Field of Classification Search

USPC ..... 271/121, 122, 124, 167, 146, 137, 104

See application file for complete search history.

(56) References Cited

U.S. PATENT DOCUMENTS

| | | | | |
|---|---|---|---|---|
| 5,882,004 | A | 3/1999 | Padget | |
| 6,042,103 | A | 3/2000 | Yraceburu et al. | |
| 6,663,098 | B2 * | 12/2003 | Teo et al. | 271/121 |
| 6,733,110 | B1 | 5/2004 | Pinkernell et al. | |
| 7,156,388 | B2 | 1/2007 | Kang et al. | |
| 7,370,858 | B2 * | 5/2008 | Youn | 271/121 |
| 7,392,979 | B2 | 7/2008 | Sasaki et al. | |
| 7,455,288 | B2 | 11/2008 | Ruhe et al. | |
| 7,810,803 | B2 | 10/2010 | Hoberock et al. | |
| 2001/0028141 | A1 | 10/2001 | Kotaka et al. | |
| 2003/0132570 | A1 * | 7/2003 | Park | 271/167 |
| 2004/0033100 | A1 | 2/2004 | Richtsmeier et al. | |
| 2005/0082742 | A1 * | 4/2005 | Kang et al. | 271/121 |
| 2005/0156372 | A1 | 7/2005 | Ramos | |
| 2008/0122162 | A1 | 5/2008 | Bokelman et al. | |
| 2009/0026693 | A1 * | 1/2009 | Lim | 271/121 |

* cited by examiner

*Primary Examiner* — Thomas Morrison

(57) ABSTRACT

Separator assembly for use with printers is described herein. One example separator assembly includes a separator pad movable between a first position and a second position such that the separator pad is to engage a leading edge of a print media in the second position. A cam is rotatable between a third position and a fourth position to move the separator pad from the first to the second position.

23 Claims, 7 Drawing Sheets

SEPARATOR ASSEMBLY FOR USE WITH PRINTERS

BACKGROUND

Printing systems such as ink jet printers often employ a feed mechanism to feed print media from an input area or tray to a print zone of the printing system. To separate sheets of print media as they enter a transport path of the printing system between the input area and the print zone, a conventional feed mechanism typically employs a separation assembly including one or more separation pads. Additionally, to reset the separation assembly and/or to realign leading edges of the print media adjacent a separator pad after a sheet of print media is picked and transported to the print zone, a conventional feed mechanism includes a reset assembly. After a sheet of print media is selected and fed through the transport path via the feed mechanism, the reset assembly is activated to move the leading edges of the stacked print media that are in contact with the separator pad away from the separator pad.

DETAILED DESCRIPTION

Figure 1:
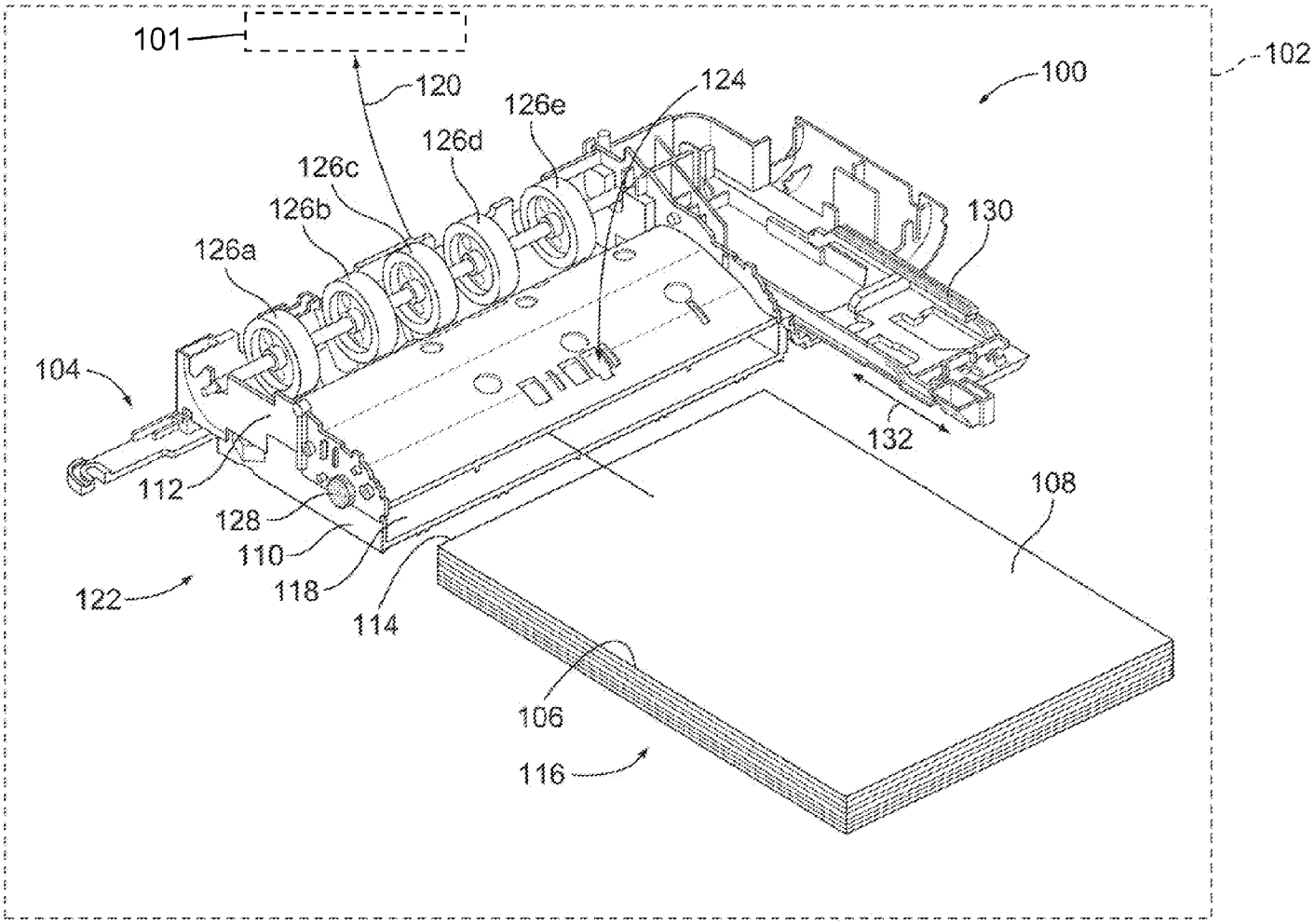
FIG. 1 is a perspective view of an example print media feed mechanism having a separator assembly in accordance with the teachings described herein.

Certain examples are shown in the above-identified figures and described in detail below. The figures are not necessarily to scale and certain features and certain views of the figures may be shown exaggerated in scale or in schematic for clarity and/or conciseness. Although the following discloses example methods and apparatus, it should be noted that such methods and apparatus are merely illustrative and should not be considered as limiting the scope of this disclosure. The illustrated examples described in the figures illustrate a separator assembly for use with media handling systems or printing systems (e.g., ink jet printing systems).

Conventional printers often employ a feed mechanism to urge or move print media toward a print zone of a printing apparatus. To prevent multiple sheets of print media from simultaneously entering the print zone, conventional printers typically employ a separation pad to separate a top sheet from a next-to-top sheet in a stack of print media. When multiple sheets from the stack of print media are advanced toward the separator pad via the feed mechanism, the separator pad often deflects, deforms or moves to allow the top sheet to be driven forward without also driving the extra sheets in the print zone. After the top-sheet is moved to the print zone, conventional printers typically employ a separate reset mechanism or assembly to move the leading edges of the remaining sheets in a stack of print media away from the separator pad to enable the separator pad to move to its non-deflected, initial position. However, having a separate reset assembly increases manufacturing costs and complexity. In some instances, a conventional reset assembly may increase the overall dimensional envelope of a printing apparatus.

Example methods, systems and apparatus described herein overcome at least the foregoing problems. Unlike conventional printers, the example reset assembly is integral with the separator assembly. As a result, the example separator assembly described herein reduces manufacturing costs and complexity.

The example separator assemblies disclosed herein provide a reset assembly or mechanism to move leading edges of a stack of print media away from a separator pad after a top sheet of print media is advanced to a print zone of the printer. In particular, an example separator assembly includes a dual function separator pad that is to separate a top sheet from a next-to-top sheet when print media is fed to a print zone of a printing apparatus and also provides a reset mechanism to move the remaining sheets of print media away from the separator pad after the top sheet is transported to the print zone to allow the separator pad to move to a non-deflected, initial position.

In some examples, an example separator assembly includes a cam that is coupled adjacent to an end of a friction arm that is to be actuated by a service sled. When actuated, the cam engages a separator pad via a pad backer and causes the separator pad to move linearly, slide, deflect, deform or otherwise move away from a base and toward a leading edge of the print media. As a result, the separator pad moves a leading edge of the print media in a direction away from the separator pad. When the friction arm is released, the cam releases the pad backer and, thus, the separator pad and the separator pad slides, deflects or otherwise moves to its initial, non-deflected position.

FIG. 1 is an example feed mechanism or assembly 100 for use with a media handling system or printing apparatus 102 having an example separator assembly 104 described herein. For example, the feed mechanism 100 may be used with a media handling system such as, for example, an ink-jet printer, a laser printer, a copier, a facsimile machine or any other media handling system that uses a feed mechanism including a separation assembly to pull or drive a sheet or a top sheet 106 of print media 108 (e.g., paper) needed for printing.

As shown in FIG. 1, the feed mechanism 100 of the illustrated example includes a media input or tray 110 coupled to a cover 112. The cover 112 of the feed mechanism 100 houses or encases one or more feed mechanism components described below. The media input 110 is to receive at least a leading edge 114 of the top sheet 106 of print media 108. For example, a stack 116 of print media 108 (e.g., a stack of 50 sheets) may be disposed on the media input 110 between a surface 118 of the media input 110 and the cover 112. The feed mechanism 100 transports or moves the print media 108 (e.g., the top sheet 106) along a media path 120 from the media input 110 and to, for example, a print zone 101 of the printing apparatus 102. To move the print media 108 to a the print zone 101 of the printing apparatus 102, the feed mechanism 100 includes a media drive 122. The media drive 122 of the illustrated example includes a pick assembly 124 that moves or urges the print media 108 from the stack 116 toward one or more drive rolls 126*a-e*. The pick assembly 124 is driven via, for example, a motor (not shown) and gear system 128. For example, when activated, the media drive 122 advances the print media 108 along the media path 120 from the media input 110 toward the print zone 101 of a printing apparatus 102. As described in greater detail below, the printing apparatus 102 of the illustrated example employs a service sled 130 that moves (e.g., linearly moves back and forth) relative to the cover 112 of the feed mechanism 100 in a direction represented by arrow 132.

Figure 2:
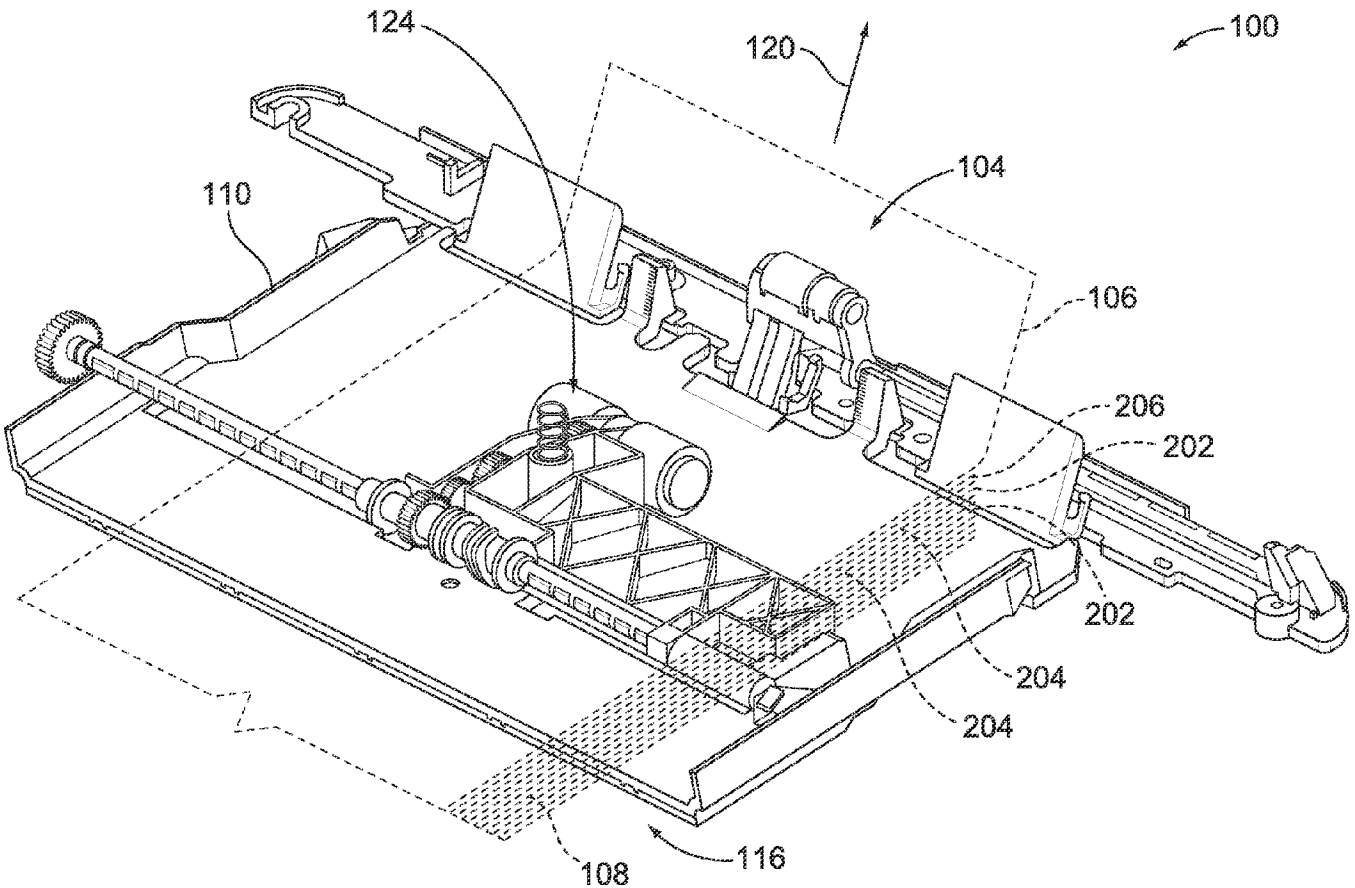
FIG. 2 is a perspective view of the example feed mechanism of FIG. 1 shown without a cover.

FIG. 2 is a perspective view of the example feed mechanism 100 of FIG. 1, but shown without the cover 112 and the drive rolls 126*a-e*. As most clearly shown in FIG. 2, the separator assembly 104 is disposed adjacent the media input 110. The media input 110 is coupled to the separator assembly 104 such that one or more leading edges 202 of the print media 108 in the media input 110 are adjacent the separator assembly 104. The pick assembly 124 of the illustrated example urges or drives the sheets 204 of the stack 116 of print media 108 from the media input 110 toward the separator assembly 104. The separator assembly 104 separates the top sheet 106 from a next-to-top sheet 206 to prevent or reduce the introduction of multiple sheets 204 simultaneously into the media path 120 of the feed mechanism 100.

Figure 3A:
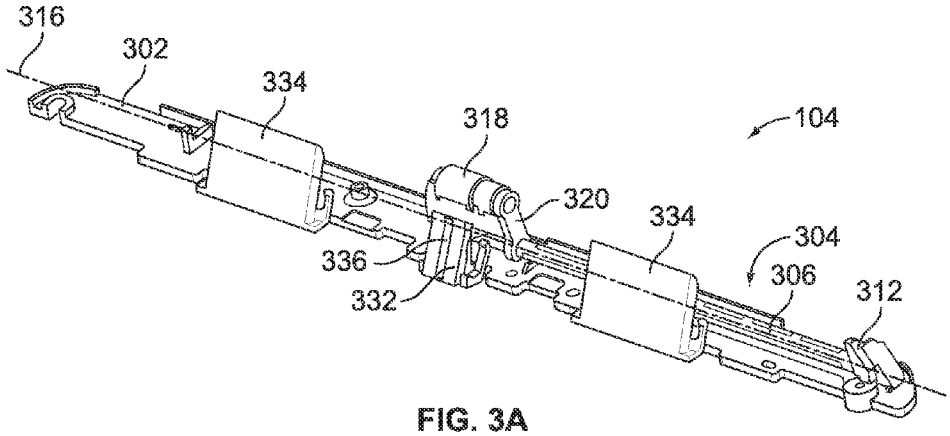
FIG. 3A is a perspective view of an example separator assembly of FIGS. 1 and 2.
Figure 3B:
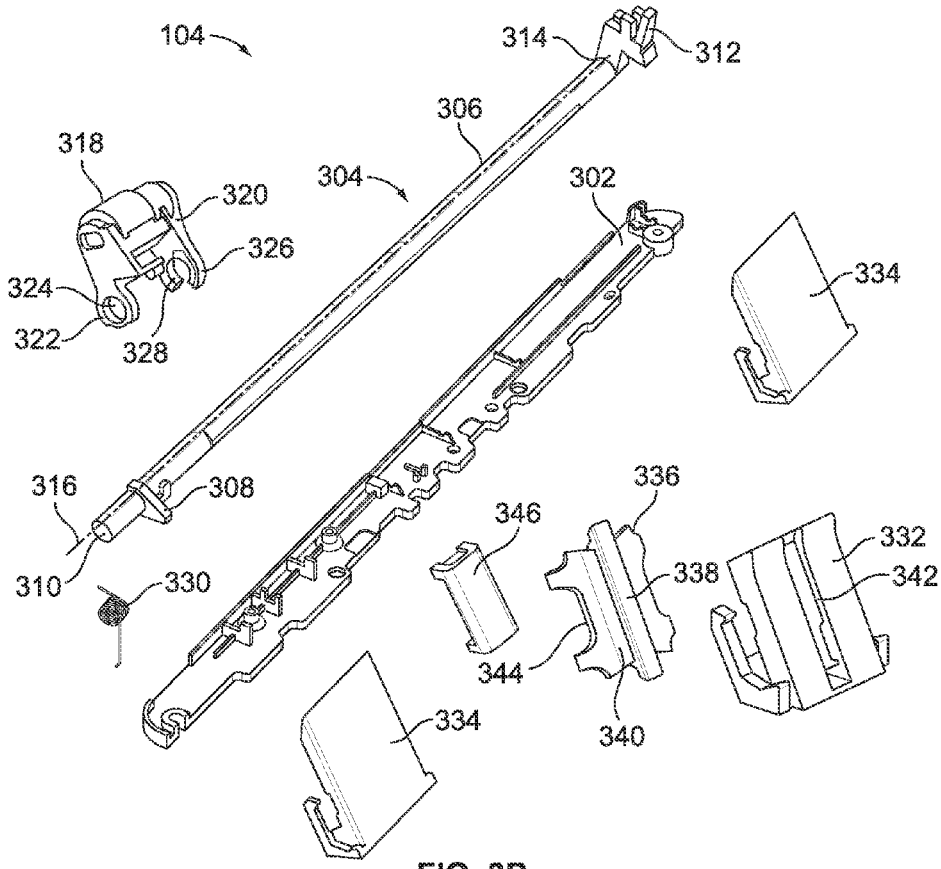
FIG. 3B is an exploded view of an example separator assembly of FIGS. 1, 2 and 3A.

FIG. 3A is a perspective view of the example separator assembly 104 of FIGS. 1 and 2. FIG. 3B is an exploded view of the example separator assembly 104 of FIGS. 1, 2 and 3A. The separator assembly 104 includes a base 302 and an actuator or actuation mechanism 304 rotatably coupled to the base 302. The actuator 304 of the illustrated example includes an actuation arm 306 having a cam 308 adjacent a first end 310 of the actuation arm 306 and a lever 312 adjacent a second end 314 of the actuation arm 306. The actuation arm 306 is depicted as a cylindrical shaft having a longitudinal axis 316 that is substantially parallel to a longitudinal length of the base 302. As shown in FIG. 3, the cam 308 is integrally formed with the actuation arm 306 as a unitary piece or structure. However, in other examples, the cam 308 may be coupled to the actuation arm 306 via, for example, a fastener.

A separator roller or friction roller 318 is coupled (e.g., fixedly coupled) to the actuation arm 306 via a support 320. The support 320 includes a leg 322 having an opening 324 to slidably receive the end 310 of the actuation arm 306 and a leg 326 having an opening 328 (e.g., a partial opening or C-shaped end) to couple to the actuation arm 306 via snap-fit so that the cam 308, when integrally formed with the actuation arm 306, does not hinder or interfere with the assembly of the support 320 and the actuation arm 306. The separator roller 318 is to engage the drive roller 126*c* (FIG. 1) to provide or establish a transport nip or pinch point through which a sheet (e.g., the top sheet 106) of print media 108 is to be advanced. To bias the separator roller 318 into engagement with the drive roller 126*c*, the separator assembly 104 of the illustrated example employs a biasing element 330 (e.g., a spring). The separator assembly 104 includes a print media lead-in or guide ramp 332 to help advance the top sheet 106 of print media 108 from the media input 110 to the separator roller 318 along the media path 120, which is non-parallel to the print media 108 when the print media 108 is disposed within the media input 110 (at an angle relative to the media input 110). Additionally, the separator assembly 104 of the illustrated example includes one or more peripheral guide ramps or blocks 334 to help guide the top sheet 106 of print media 108 along the media path 120. In the illustrated example, the guide ramp 332 and the guide ramps 334 are fixedly coupled relative to the base 302.

To reduce or eliminate the incidence of feeding multiple sheets 204 of the print media 108 into the media path 120 simultaneously, the separator assembly 104 of the illustrated example employs a separator pad 336. The separator pad 336 includes a surface 338 (e.g., a frictional surface) that protrudes from a body portion 340 of the separator pad 336 and which is to be arranged adjacent the media input 110. Further, the separator pad 336 moves, deflects, slides, deforms or otherwise moves relative to the base 302 and/or the guide ramp 332. In particular, the surface 338 of the separator pad 336 engages and/or protrudes from a slot 342 of the guide ramp 332 and is sized to move, deflect, deform or slide relative to, or within, the slot 342 of the guide ramp 332. A surface 344 of the separator pad 336 opposite the surface 338 is orientated relative to, or substantially aligned with, the cam 308 of the actuation arm 306.

The separator pad 336 of the illustrated example is composed of a rubber material and provides a coefficient of friction with a sheet (e.g., the top sheet 106) of print media 108 that is greater than the coefficient of friction between adjacent sheets (e.g., the next-to-top sheet 206 of FIG. 2) of print media 108. In other examples, the separator pad 336 may be composed of metal, plastic, or any other suitable material and may be formed via, for example, injection molding. In some examples, the separator pad 336 may be composed of, for example, a plastic material and the surface 338 may include a strip of rubber material (e.g., attached via adhesive) to provide sufficient friction to separate a top-sheet from a next-to-top sheet. In some examples, the surface 338 of the separator pad 336 may be composed of a rubber material that is overmolded with the body portion 340 of the separator pad 336, which may be composed of a plastic material. Also, the surface 338 of the illustrated example has a rectangular cross-sectional shape or profile. However, in other examples, the cross-sectional shape or profile of the surface 338 may be circular, square or any other suitable shape or profile.

To facilitate movement of the separator pad 336 relative to the base 302, the separator assembly 104 of the illustrated example includes a pad backer 346. The pad backer 346 is disposed between the cam 308 of the actuation arm 306 and the separator pad 336. In particular, the pad backer 346 of the illustrated example floats between the cam 308 and the separator pad 336. The pad backer 346 is substantially aligned with the cam 308 and transfers a load from the cam 308 to the separator pad 336. In particular, the pad backer 346 significantly reduces or prevents damage to the separator pad 336 that may otherwise occur during rotation of the cam 308 against the separator pad 336.

Figure 4:
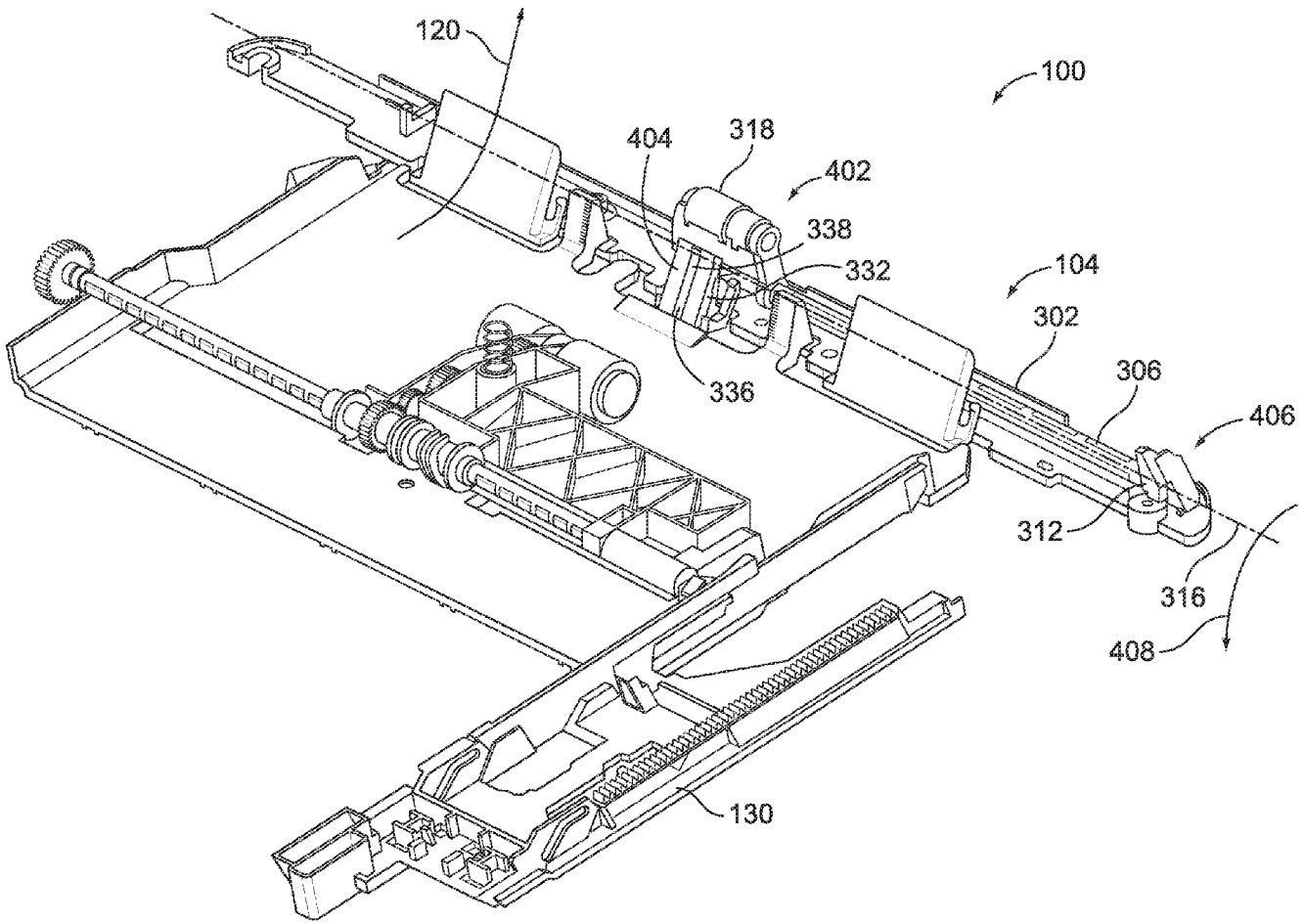
FIG. 4 is a perspective view of the example feed mechanism of FIG. 2 illustrating a service sled of an example printing apparatus in a first position relative to the separator assembly.

FIG. 4 is a perspective view of the feed mechanism 100 of FIG. 2 with the separator assembly 104 of FIGS. 1, 2, 3A and 3B shown in a first or initial position 402 (e.g., a non-deflected or separation position). In the first position 402, the surface 338 of the separator pad 336 protrudes a first distance (e.g., approximately between 0.10 and 0.5 millimeters) within the print media path 120 through the slot 342 of the guide ramp 332. In other words, in the first position 402, the surface 338 of the separator pad 336 protrudes relative to a surface or face 404 of the guide ramp 332 a first distance in a direction toward the media input 110 or away from the base 302. Additionally, the actuation arm 306 is in a relaxed or non-activated position 406 such that the separator roller 318 is biased into engagement with the drive roller 126*c* (FIG. 1) via the biasing element 330 (FIG. 3B). For example, to move the separator assembly 104 to the first position 402, the biasing element 330 biases the separator roller 318 and/or the actuation arm 306 in a first rotational direction 408 about the axis 316 of the actuation arm 306 (e.g., a counter-clockwise direction in the orientation of FIG. 4). For example, when the service sled 130 is positioned away from the lever 312 of the actuation arm 306, the biasing element 330 biases the actuation arm 306 to the first position 402 as shown in FIG. 4.

Figure 5:
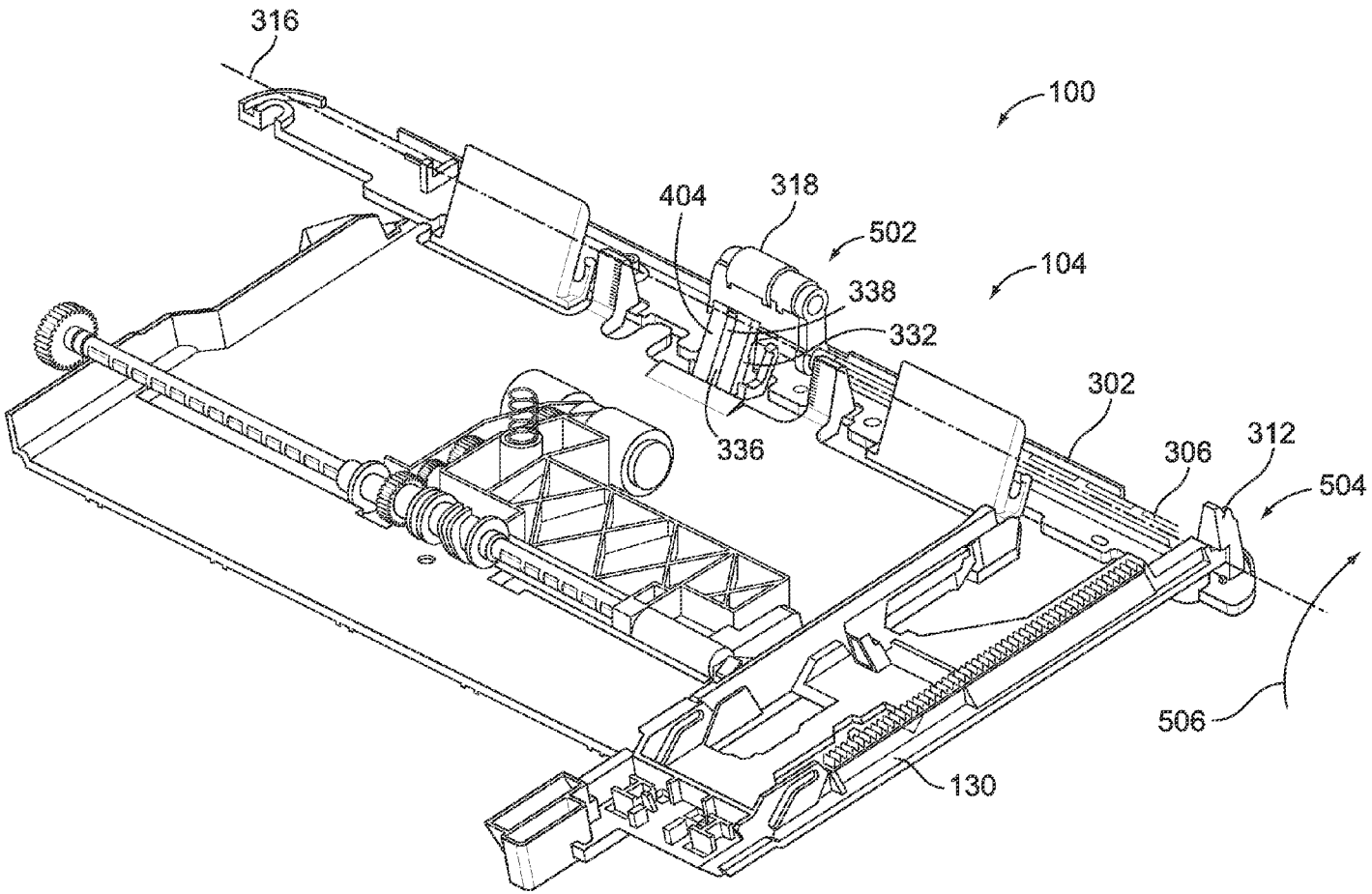
FIG. 5 is a perspective view of the example feed mechanism of FIG. 5 showing the service sled of the example printing apparatus in a second position relative to the separator assembly.

FIG. 5 is a perspective view of the feed mechanism 100 of FIG. 2 with the separator assembly 104 of FIGS. 1, 2, 3A and 3B shown in a second position 502 (e.g., a reset position or condition). In the second position 502, the surface 338 of the separator pad 336 protrudes further into the print media path 120 through the slot 342 of the guide ramp 332 than in the first position 402. In other words, in the second position 502, the surface 338 of the separator pad 336 protrudes or deflects relative to the surface 404 of the guide ramp 332 a second distance (e.g., approximately between 0.50 and 1.0 millimeters) in a direction toward the media input 110 or away from the base 302. In the illustrated example, the second distance is greater than the first distance. More specifically, the separator pad 336 moves, slides or otherwise deflects (e.g., linearly moves) toward the leading edges of the print media 108.

Additionally, the actuation arm 306 is in a non-relaxed or activated position 504 such that the separator roller 318 is to disengage the drive roller 126*c* (FIG. 1). In the second position 502, the actuation arm 306 rotates in a second direction 506 about the axis 316 of the actuation arm 306 (e.g., a clockwise direction in the orientation of FIG. 5). For example, to move the separator assembly 104 to the second position 502, the printing apparatus 102 (FIG. 1) may employ the service sled 130.

For example, as shown in FIG. 5, the service sled 130 is in engagement with the actuation arm 306. The service sled 130 engages the lever 312 of the actuation arm 306 to rotate the actuation arm 306 in the second direction 506. For example, the service sled 130 may be activated or driven toward the lever 312 of the actuation arm 306 to move the actuation arm 306 to the activated position 504 after a sheet (e.g., the top sheet 106) from the stack 116 of print media 108 is advanced through the media path 120. For example, operation of the service sled 130 may be performed via a controller or processor (not shown) of the printing apparatus 102. For example, the controller or processor may command a drive unit (e.g., a motor) to move the service sled 130 between the position shown in FIG. 4 and the position shown in FIG. 5.

In some examples, the controller may cause the service sled 130 to be driven back and forth relative to the lever 312 to cause the actuation arm 306 to rotate between the positions 406 and 504 over a short duration of time (e.g. rapid movement), thereby pulsing the separator pad 336 to push or move the leading edges of the next-to-top sheets off of and/or away from the separator pad 336.

Figure 6A:
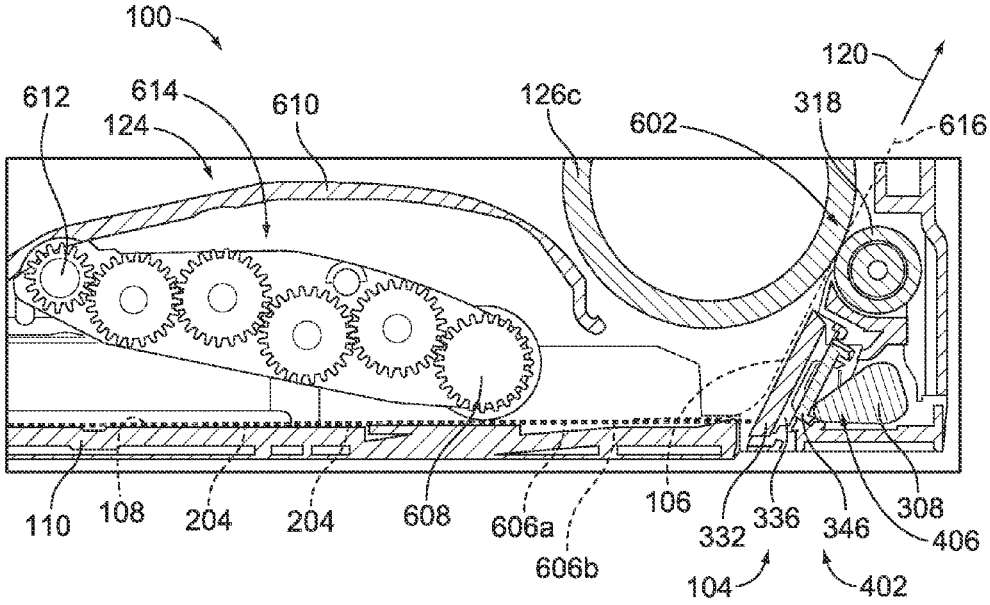
FIG. 6A is a cross-sectional view of the example feed mechanism of FIGS. 1, 2 and 4 shown in the first position.

FIG. 6A is a cross-sectional view of the example feed mechanism 100 of FIG. 4. As shown in FIG. 6A, the separator assembly 104 is in the first position 402 such that the separator roller 318 is in engagement with the drive roller 126*c* to define or form a transport nip or pinch area 602. In operation, the drive roller drives the separator roller 318. With the separator roller 318 in engagement with the drive roller 126*c*, the transport nip 602 advances or moves the top sheet 106 to, for example, a print zone 101 (FIG. 1) of the printing apparatus 102.

As noted above, in the first position 402, the surface 338 of the separator pad 336 protrudes a first distance from the surface 404 of the guide ramp 332 or otherwise extends into the media path 120 to help separate the top sheet 106 from respective next-to-top sheets 606*a* and 606*b* and prevent the next-to-top sheets 606*a* and/or 606*b* from being carried along with the top sheet 106 into the transport nip 602.

In operation, the pick arm assembly 124 urges or drives print media 108 toward the separator assembly 104. For example, the pick arm assembly 124 may include a pick roller 608 mounted to a pick roller swing arm 610 that is pivotally coupled relative to the media input 110. The swing arm 610 is biased toward the top sheet 106 of the print media 108 (e.g., a downward direction in the orientation of FIG. 6A) so that the swing arm 610 rests against the print media 108 disposed in the media input 110 to provide sufficient frictional force (e.g., downward force).

During a printing operation, the pick roller 608 is driven via a shaft 612 and a gear train 614 at the direction of, for example, a controller. As the pick roller 608 rotates, the pick roller 608 urges the top sheet 106 toward the separator pad 336, which helps prevent or significantly reduce the incidence of the next-to-top sheets 606*a* and/or 606*b* from advancing simultaneously with the top sheet 106 through the transport nip 602. When a leading edge 616 of the top sheet 106 (or leading edges of the sheets 204) strikes or engages the separator pad 336, the separator pad 336 moves, slides, deforms, deflects or otherwise shifts relative to the base 302 and/or the guide ramp 332 (e.g., in a direction away from the media path 120 toward the base 302). In other words, the leading edges of the sheets 204 cause the surface 338 of the separator pad 336 to deflect slightly relative to the surface 404 of the guide ramp 332. For example, this slightly deflected position of the separator pad 336 can be considered a third position.

As a result, the separator pad 336 friction allows only the top sheet 106 to advance to the transport nip 602. The force of pick roller 608 on the top sheet 106 is sufficient to overcome the resistance provided by the surface 338 of separator pad 336 while the next-to-top sheet 606*a*, which may be dragged along with a much smaller sheet-to-sheet friction force with top sheet 106, will be stopped by the separator pad 336. In particular, the next-to-top sheet 606*a* will be stopped by the friction provided by the surface 338 of the separator pad 336 being in the media path 120. Thus, the separator pad 336 separates the next-to-top sheet 606*a* from the top sheet 106.

The top sheet 106 continues to be driven forward toward the drive roller 126*c* and the separator roller 318, while the separator pad 336 stops the leading edges of the sheets 204 of the print media 108 (e.g., the sheets 606*a* and/or 606*b*) remaining in engagement with or adjacent the separator pad 336. Additionally, the top sheet 106 is guided from the media input 110 toward the drive roller 126*c* along the guide ramps 334.

Further, although not shown, a friction spring is coupled to the separator roller 318 to provide a rotational resistance to the separator roller 318. The force provided by the drive roller 126*c* is sufficient to overcome the resistance of the separator roller 318 provided by the friction spring. When the top sheet 106 of print media 108 enters the transport nip 602 formed by the drive roller 126*c* being in engagement with the separator roller 318, the top sheet 106 is driven with enough force to overcome the resistance provided by the friction spring of the separator roller 318. However, if multiple sheets (e.g., the sheets 106, 606*a* and/or 606*b*) simultaneously enter the transport nip 602, the additional sheets (driven by the top sheet 106) will lack a sufficient drive force to overcome the resistance provided by the friction spring of the separator roller 318, preventing the separator roller 318 from rotating. In this manner, the frictional spring of the separator roller 318 provides a secondary or back-up separation device.

Figure 6B:
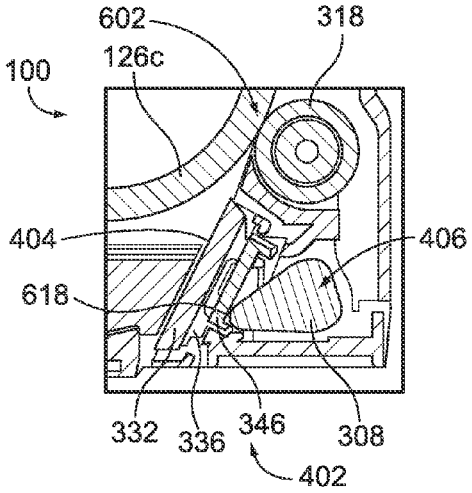
FIG. 6B is an enlarged cross-sectional view of the example separator assembly of FIG. 6A.

FIG. 6B is an enlarged, partial cross-sectional view of the example feed mechanism 100 of FIG. 6A, showing the actuator arm 306 in the relaxed position 406. In the relaxed position 406, a tip 618 of the cam 308 is disengaged from the pad backer 346 or otherwise does not influence or bias the separator pad 336 via the pad backer 346. In other words, the pad backer 346 is operatively or effectively disengaged from the separator pad 336. Thus, the separator pad 336 may move, flex, bend, deform or otherwise shift relative to the guide ramp 332 without interference from the cam 308 and/or the pad backer 346 when a leading edge of print media 108 strikes or engages the separator pad 336.

As noted above, when the top sheet 106 is driven forward by the pick roller 608, the surface 338 of the separator pad 336 deflects (e.g., slightly deflects) relative to the surface 404 of the guide ramp 332 (e.g., the third position). Thus, after the top sheet 106 advances through the transport nip 602 and to the print zone, it is often necessary to reset the separator pad 336 and shift or move the leading edges of the print media 108 away from the surface 338 of the separator pad 336 to allow the separator pad 336 to move to the first position 402. In particular, the separator pad 336 is most effective when the separator pad 336 is in its initial, non-deflected position relative to the guide ramp 332. To reset the separator pad 336 to the first position 402, the actuation arm 306 is moved to the activated position 502.

Figure 7:
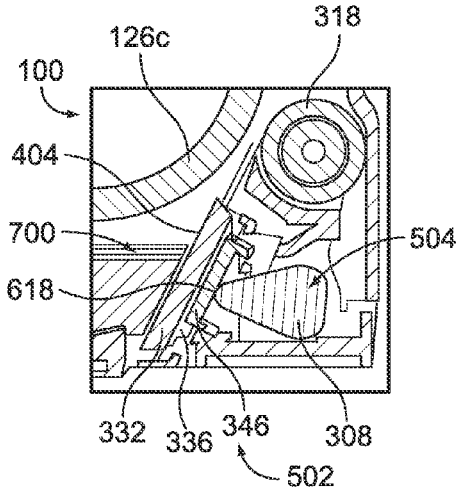
FIG. 7 is a partial cross-sectional view of the example separator assembly of FIGS. 1, 2 and 5 providing a reset condition.

FIG. 7 is an enlarged, partial cross-sectional view of the example feed mechanism 100 of FIGS. 6A and 6B showing the actuator arm 306 in the activated position 502. More specifically, FIG. 7 illustrates the separator assembly 104 providing or functioning as a reset mechanism 700. For example, to move the separator assembly 104 to the second position 502 or the reset condition 700, a controller or microprocessor of the printing apparatus 102 may cause the service sled 130 to move to the position of FIG. 5 to engage the lever 312. When the service sled 130 engages the lever 312, the actuation arm 306 rotates in the direction 506 to cause the tip 618 of the cam 308 to engage the pad backer 346 and cause the pad backer 346 to slide or move in a direction perpendicular to the axis 316 of the actuation arm 306 and toward the separator pad 336. In turn, the pad backer 346 causes the separator pad 336 to move, deflect, slide or otherwise shift relative to the guide ramp 332. In the second position 502, the surface 338 of the separator pad 336 further protrudes the second distance away from the surface 404 of the guide ramp 332 and toward the media input 110 compared to the separator pad 336 being in the first position 402 as shown in FIGS. 6A and 6B. As a result, the surface 338 of the separator pad 336 slightly shifts the leading edges of the print media 108 away from the surface 338 of the separator pad 336.

When the separator assembly 104 is re-positioned to the first position 402 as shown in FIGS. 6A and 6B (i.e., the service sled 130 releases the lever 312), the cam 308 releases the pad backer 346. In turn, the pad backer 346 releases the separator pad 336 allowing the separator pad 336 to slide or move to its first position 402. This operation is repeated after each sheet from the stack 116 of print media 108 is advanced through the transport area 602. Thus, unlike conventional feed mechanisms and/or printing apparatus, which employ a separator assembly that is separate from a reset mechanism, the example separator assembly 104 includes an integral reset mechanism 700, thereby reducing manufacturing costs and complexity.

Figure 8:
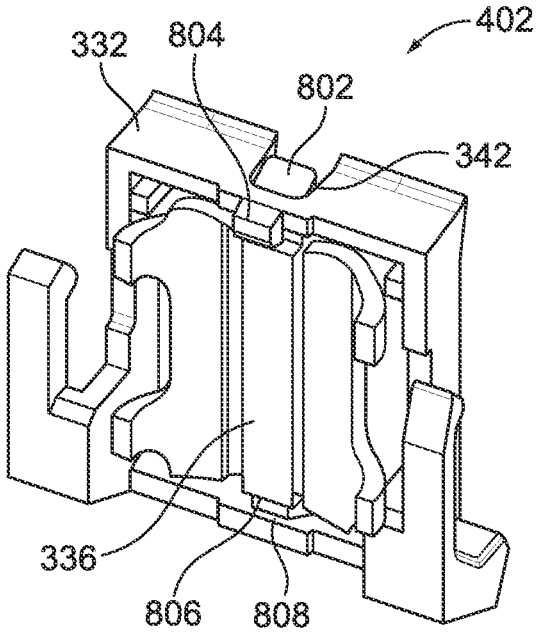
FIG. 8 is a partial, perspective rear view of the example separator assembly shown in the first position.

FIG. 8 is a perspective, rear view of the separator pad 336 and the guide ramp 332 when the separator pad 336 is in the initial, first position 402. As shown in FIG. 8, an upper portion 802 of the separator pad 336 engages a lip 804 of the guide ramp 332 and a lower portion or tab 806 of the separator pad 336 engages a wall 808 formed by the slot 342 when the separator pad 336 is in the first position 402 (i.e., a non-deflected position).

Figure 9:
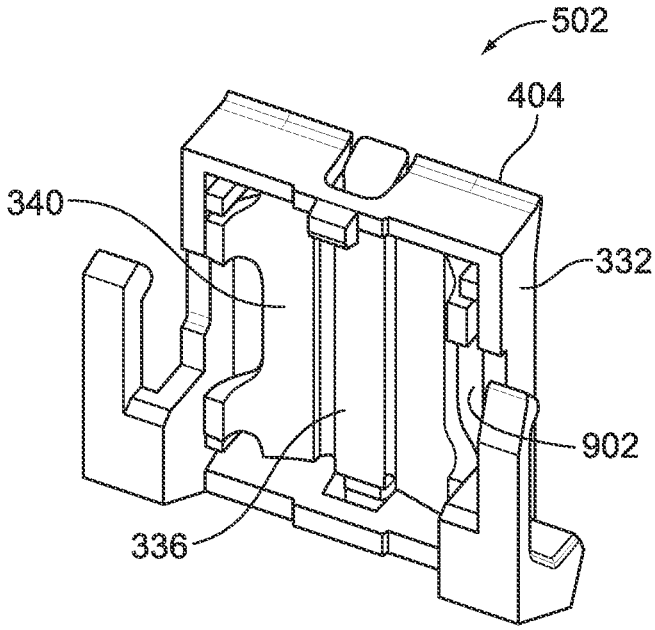
FIG. 9 is a partial, perspective rear view of the example separator assembly shown in the second position.

FIG. 9 is a perspective, rear view of the separator pad 336 and the guide ramp 332 when the separator pad 336 is in the second position 502 (e.g., a deflected position). As shown in FIG. 9, the separator pad 336 deflects, slides, shifts or moves relative to the guide ramp 332. In particular the body portion 340 of the separator pad 336 engages an inner surface 902 of the guide ramp 332 opposite of the surface 404, which causes the surface 338 of the separator pad 336 to further protrude to the second distance in the media path 120 as described above.

At least some of the aforementioned examples include one or more features and/or benefits including, but not limited to, a separator assembly having a separator pad moveably coupled relative to a guide ramp. The separator pad has a first position in which a surface the separator pad protrudes a first distance within a media path relative to the guide ramp. The surface of the separator pad is to deflect to a second position relative to the guide ramp and away from the media path when a print media engages the separator pad. An actuator to engage the separator pad to move the surface of the separator pad to a third position in which the surface of the separator pad protrudes a second distance into the media path relative to the guide ramp. The first distance being less than the second distance.

In some examples, a separator roller is coupled to the actuation arm. The separator roller is to frictionally engage a drive roller of a feed mechanism. The separator roller is to disengage the drive roller when the actuation arm is rotated relative to the base between respective fourth and fifth positions.

The example methods and apparatus described above were developed in an effort to improve the performance of a separator apparatus in media handling system such as an inkjet printer and to reduce the costs and complexity associated with manufacturing. Thus, embodiments of the disclosure are described with reference to a separator assembly for a media handling system. As noted at the beginning of this Description, the examples shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A separator assembly comprising a separator pad moveably coupled to a guide ramp, the separator pad having a first position in which a surface of the separator pad protrudes a first distance within a media path relative to the guide ramp, the surface of the separator pad to deflect to a second position relative to the guide ramp and away from the media path when a print media engages the separator pad;

an actuator to engage the separator pad to move the surface of the separator pad to a third position in which the surface of the separator pad protrudes a second distance into the media path relative to the guide ramp, the first distance being less than the second distance; and a separator roller coupled to the actuator, the separator roller to frictionally engage a drive roller of a feed mechanism, and the separator roller to disengage the drive roller when the actuator is rotated relative to a base between respective first and second positions.

2. A separator assembly comprising:

a separator pad disposed within a media path of a printing apparatus, the separator pad deflectable relative to a base;

an actuator rotatably coupled relative to the separator pad, rotation of the actuator to cause the separator pad to move further into the media path to move leading edges of print media away from the separator pad subsequent to a top sheet being transported to a print zone, wherein the actuator is activated via a service sled of the printing apparatus; and a pad backer disposed between the separator pad and the actuator, the pad backer movably coupled relative to the separator pad.

3. A separator assembly comprising:

a separator pad disposed within a media path of a printing apparatus, the separator pad deflectable relative to a base;

an actuator rotatably coupled relative to the separator pad, rotation of the actuator to cause the separator pad to move further into the media path to move leading edges of print media away from the separator pad subsequent to a top sheet being transported to a print zone;

a pad backer disposed between the separator pad and the actuator, the pad backer movably coupled relative to the separator pad; and a service sled to engage a lever to activate an actuation arm and a cam, the cam is to engage the pad backer to move the pad backer toward the separator pad such that the separator pad further moves into the media path to reset a leading edge of print media relative to the separator pad.

4. A separator pad assembly comprising:

a separator pad moveably coupled relative to a guide ramp between a first position and a second position, the separator pad having a surface dimensioned and positioned to protrude a first distance within a media path relative to the guide ramp to separate a first print media sheet from a plurality of print media sheets when the separator pad is in the first position, the surface of the separator pad structured and dimensioned to deflect to a deflected position relative to the guide ramp and away from the media path in response to engagement of the first print media sheet with the separator pad; and an actuator structured and positioned to engage the separator pad to move the surface of the separator pad to the second position in which the surface of the separator pad protrudes a second distance into the media path relative to the guide ramp, the first distance being less than the second distance, the separator pad being dimensioned to engage a leading edge of the plurality of print media sheets when the separator pad enters the second position to move the leading edge away from the separator pad after the first print media sheet has been separated from the plurality of print media sheets, wherein the separator pad is free to slide relative to the guide ramp without interference from the actuator when the first print media sheet engages the separator pad.

5. A separator assembly of claim 4, further comprising a pad backer disposed between the actuator and the separator pad.

6. A separator assembly of claim 4, wherein the actuator comprises a cam coupled to an actuation arm.

7. A separator assembly of claim 6, wherein the cam is to operatively decouple from the separator pad when the separator pad deflects relative to a base of the separator assembly.

8. A separator assembly of claim 6, wherein the actuation arm is rotated relative to the guide ramp to cause the separator pad to move further into the media path.

9. A separator assembly of claim 6, further comprising a lever coupled to a first end of the actuation arm opposite a second end having the cam.

10. A separator assembly comprising:

a separator pad moveably coupled relative to a guide ramp to move between a first position and a second position, the separator pad having a surface dimensioned and positioned to protrude a first distance within a media path relative to the guide ramp to separate a first print media sheet from a plurality of print media sheets when the separator pad is in the first position, the surface of the separator pad structured and dimensioned to deflect to a deflected position relative to the guide ramp and away from the media path in response to engagement of the first print media sheet with the separator pad;

a pad backer disposed on the separator pad; and an actuator having a cam structured and positioned to move along a surface of the pad backer on the separator pad to move the surface of the separator pad to the second position in which the surface of the separator pad protrudes a second distance into the media path relative to the guide ramp, the first distance being less than the second distance, the separator pad being dimensioned to engage a leading edge of the plurality of print media sheets when the separator pad enters the second position to move the leading edge away from the separator pad after the first print media sheet has been separated from the plurality of print media sheets, the actuator to move the separator pad from the deflected position to the second position, and the actuator to release the separator pad to enable the separator pad to move from the first position to the deflected position.

11. A separator assembly of claim 10, wherein the cam is coupled to an actuation arm.

12. A separator assembly of claim 11, wherein the cam is structured and positioned to rotate between a third position and a fourth position to move the separator pad between the first position and the second position, the cam to operatively decouple from the separator pad when the separator pad moves from the first position to the deflected position.

13. A separator assembly of claim 11, wherein the actuation arm is to rotate relative to the guide ramp to cause the separator pad to move between the respective first and second positions.

14. A separator assembly of claim 11, further comprising a lever coupled to a first end of the actuation arm opposite a second end having the cam.

15. A separator assembly comprising:

a separator pad to be positioned within a media path of a printing apparatus, the separator pad structured and dimensioned to deflect relative to a base to separate a first print media from a second print media;

an actuator rotatably coupled to the separator pad, rotation of the actuator to move the separator pad further into the media path to move a leading edge of the second print media away from the separator pad subsequent to first print media being separated from the second print media and transported to a print zone; and a pad backer positioned between the separator pad and the actuator, the pad backer being slidably coupled to the separator pad to enable the separator pad to slide relative to the pad backer when the separator pad deflects relative to the base to separate the first print media from the second print media.

16. A separator assembly of claim 15, wherein the actuator comprises an actuation arm rotatably coupled to the base, the actuation arm having a cam adjacent a first end of the actuation arm and a lever adjacent a second end of the actuation arm.

17. A separator assembly of claim 15, wherein the actuator is to operatively decouple from the separator pad when the separator pad deflects relative to the base.

18. A separator assembly of claim 17, wherein the actuator is to disengage the pad backer when the separator pad deflects relative to the base.

19. A separator assembly of claim 15, wherein the separator pad deflects relative to the base when the first print media engages the separator pad.

20. A separator assembly of claim 19, wherein the separator pad is to deflect relative to the base without interference from the actuator when the first print media engages the separator pad.

21. A separator assembly of claim 15, further comprising a guide ramp having a slot to receive a surface of the separator pad.

22. A separator assembly of claim 21, wherein the separator pad is slidably coupled to the guide ramp.

23. A separator assembly of claim 21, wherein the pad backer is slidably coupled to the guide ramp.

* * * * *